US005828287A

United States Patent [19]

Nilson

[11] Patent Number: 5,828,287

[45] Date of Patent: Oct. 27, 1998

[54] AUTOMATIC THERMAL SHUT-OFF SWITCH

[76] Inventor: Bruce G. Nilson, 1155 White Horse Pike, Hammonton, N.J. 08037

[21] Appl. No.: 775,726

[22] Filed: Dec. 31, 1996

[51] Int. Cl.[6] ..... H01H 37/48

[52] U.S. Cl. ..... 337/394; 337/3; 337/16; 337/97; 337/380

[58] Field of Search ..... 337/3, 15, 16, 337/36, 97, 101, 314, 315, 317, 380, 382, 383, 398, 394, 399; 417/32

[56] References Cited

U.S. PATENT DOCUMENTS

| | | | |
|---|---|---|---|
| 2,748,224 | 5/1956 | Dillman et al. | 337/317 |
| 4,074,575 | 2/1978 | Bergman et al. | 200/61.4 X |
| 4,257,745 | 3/1981 | Thur et al. | 417/18 |
| 4,555,688 | 11/1985 | Bayer | 337/394 |
| 4,887,062 | 12/1989 | Bletz | 337/3 X |
| 5,089,799 | 2/1992 | Sorenson | 337/68 |
| 5,145,322 | 9/1992 | Senior, Jr. et al. | 417/32 |
| 5,181,005 | 1/1993 | Bayer | 337/354 |
| 5,309,131 | 5/1994 | Hofsass | 337/102 |

*Primary Examiner*—Leo P. Picard
*Assistant Examiner*—Jayprakash N. Gandhi

[57] ABSTRACT

A new Automatic Thermal Shut-Off Switch for preventing heat damage to a high pressure low volume water pump. The inventive device includes a T-shaped housing having a longitudinal cavity, a bimetallic compression spring within the cavity, a disc within cavity on top of the spring, a pin orthogonally secured to the disc, a first contact, and a second contact electrically in contact. The housing is positioned within an unused port within a pump housing and conducts the heat produced by the pump. The conducted heat expands the spring thereby forcing the pin upwardly to separate the first contact from electrically contact with the second contact.

6 Claims, 3 Drawing Sheets

10
16
20
29
28
18
4
4
12
14

10
18
28
20
29
16
12
14

AUTOMATIC THERMAL SHUT-OFF SWITCH

BACKGROUND OF THE INVENTION

1. Field of the Invention

The present invention relates to Thermal Switch Devices and more particularly pertains to a new Automatic Thermal Shut-Off Switch for preventing heat damage to a high pressure low volume water pump.

2. Description of the Prior Art

The use of Thermal Switch Devices is known in the prior art. More specifically, Thermal Switch Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Thermal Switch Devices include U.S. Pat. No. 4,074,575; U.S. Pat. No. 5,145,322; U.S. Pat. No. 5,309,131; U.S. Pat. No. 5,181,005; U.S. Pat. No. 5,089,799 and U.S. Pat. No. 4,257,745.

While these devices fulfill their respective, particular objectives and requirements, the aforementioned patents do not disclose a new Automatic Thermal Shut-Off Switch. The inventive device includes a T-shaped housing having a longitudinal cavity, a bimetallic compression spring within the cavity, a disc within cavity on top of the spring, a pin orthogonally secured to the disc, a first contact, and a second contact electrically in contact.

In these respects, the Automatic Thermal Shut-Off Switch according to the present invention substantially departs from the conventional concepts and designs of the prior art, and in so doing provides an apparatus primarily developed for the purpose of preventing heat damage to a high pressure low volume water pump.

SUMMARY OF THE INVENTION

In view of the foregoing disadvantages inherent in the known types of Thermal Switch Devices now present in the prior art, the present invention provides a new Automatic Thermal Shut-Off Switch construction wherein the same can be utilized for preventing heat damage to a high pressure low volume water pump.

The general purpose of the present invention, which will be described subsequently in greater detail, is to provide a new Automatic Thermal Shut-Off Switch apparatus and method which has many of the advantages of the Thermal Switch Devices mentioned heretofore and many novel features that result in a new Automatic Thermal Shut-Off Switch which is not anticipated, rendered obvious, suggested, or even implied by any of the prior art Thermal Switch Devices, either alone or in any combination thereof.

To attain this, the present invention generally comprises a T-shaped housing having a longitudinal cavity, a bimetallic compression spring within the cavity, a disc within cavity on top of the spring, a pin orthogonally secured to the disc, a first contact, and a second contact electrically in contact.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. The invention is may be equipped with various types of electrical cut-off switches. A conventional switch which, when activated, would disengage power, but once a normal operating temperature is reestablished this type of switch is manually restarted. Also, it is to be understood that the phraseology and terminology employed herein are for the purpose of description and should not be regarded as limiting.

If the Automatic Thermal Shut-Off Switch is equipped with a spring loaded pin switch, this switch would automatically restart the pump when normal operating temperature is achieved. The thermo switch could be fitted with an on/off switch plus a radio warning device to notify a receiver in plant operation station or could be sent via satellite from a remote isolated area which could be powered by solar cell or battery pack. The invention can be equipped with a variety of bi-metallic springs to operate in a multitude of temperature ranges.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Automatic Thermal Shut-Off Switch apparatus and method which has many of the advantages of the Thermal Switch Devices mentioned heretofore and many novel features that result in a new Automatic Thermal Shut-Off Switch which is not anticipated, rendered obvious, suggested, or even implied by any of the prior art Thermal Switch Devices, either alone or in any combination thereof.

It is another object of the present invention to provide a new Automatic Thermal Shut-Off Switch which may be easily and efficiently manufactured and marketed.

It is a further object of the present invention to provide a new Automatic Thermal Shut-Off Switch which is of a durable and reliable construction.

An even further object of the present invention is to provide a new Automatic Thermal Shut-Off Switch which is susceptible of a low cost of manufacture with regard to both materials and labor, and which accordingly is then susceptible of low prices of sale to the consuming public, thereby making such Automatic Thermal Shut-Off Switch economically available to the buying public.

Still yet another object of the present invention is to provide a new Automatic Thermal Shut-Off Switch which provides in the apparatuses and methods of the prior art some of the advantages thereof, while simultaneously overcoming some of the disadvantages normally associated therewith.

Still another object of the present invention is to provide a new Automatic Thermal Shut-Off Switch for preventing heat damage to a high pressure low volume water pump.

Yet another object of the present invention is to provide a new Automatic Thermal Shut-Off Switch which includes a T-shaped housing having a longitudinal cavity, a bimetallic compression spring within the cavity, a disc within cavity on top of the spring, a pin orthogonally secured to the disc, a first contact, and a second contact electrically in contact.

Still yet another object of the present invention is to provide a new Automatic Thermal Shut-Off Switch that prevents a homeowner from having to replace a costly pump due to overheating because a well went dry or the pump lost its prime.

Even still another object of the present invention is to provide a new Automatic Thermal Shut-Off Switch that automatically turns off electrically power to an electric motor connected to the pump when the pump is overheating.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
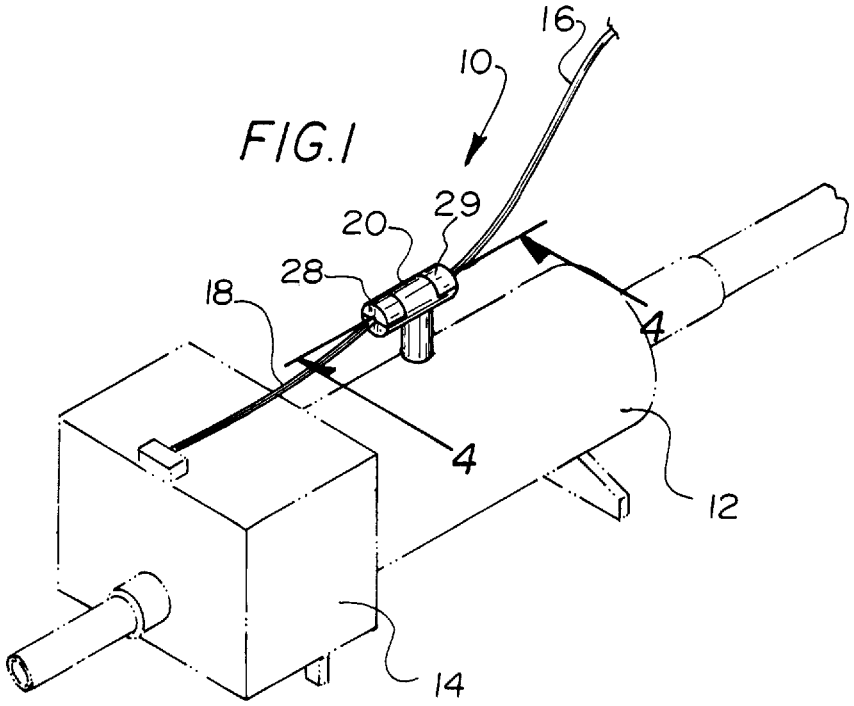
FIG. 1 is an upper perspective view of a new Automatic Thermal Shut-Off Switch according to the present invention.
Figure 2:
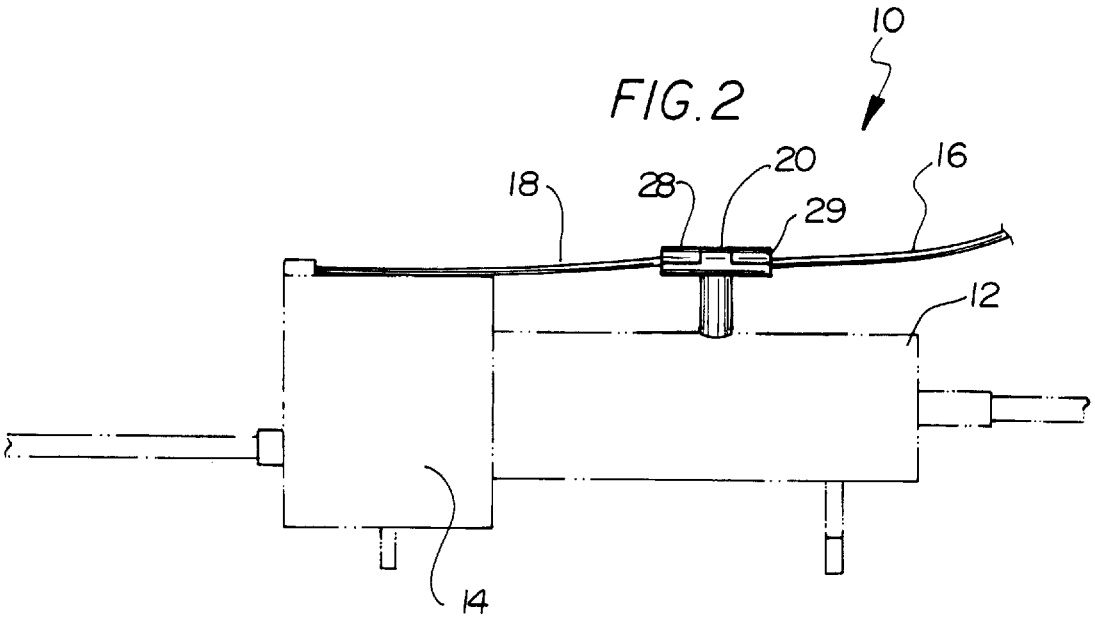
FIG. 2 is a side view of the present invention.
Figure 3:
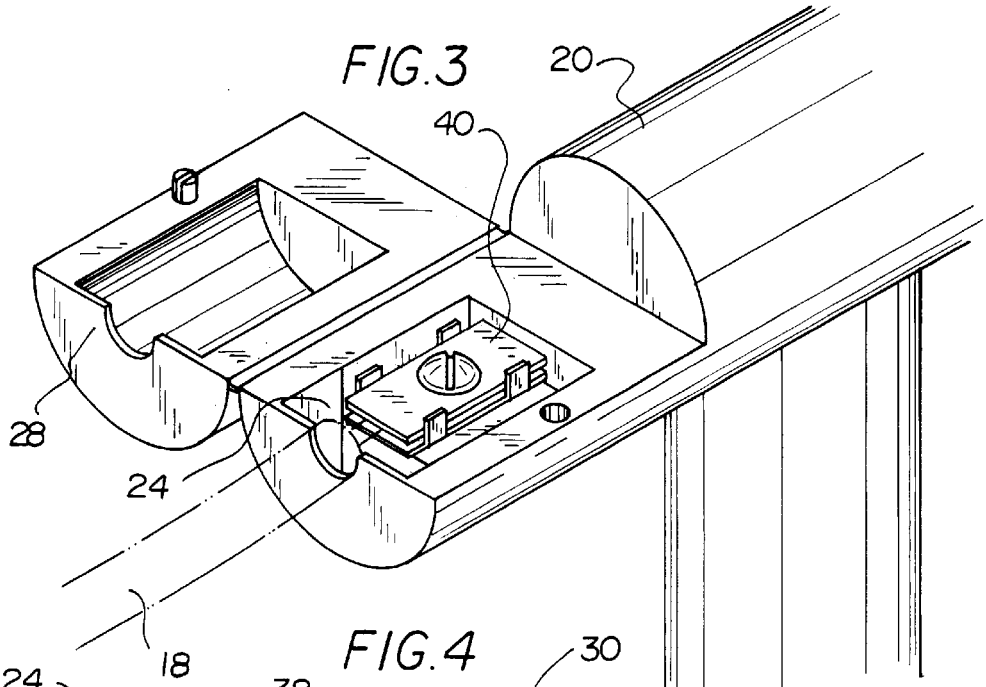
FIG. 3 is a magnified upper side perspective view of the present invention.

With reference now to the drawings, and in particular to FIGS. 1 through 6 thereof, a new Automatic Thermal Shut-Off Switch embodying the principles and concepts of the present invention and generally designated by the reference numeral 10 will be described.

More specifically, it will be noted that the Automatic Thermal Shut-Off Switch 10 comprises a T-shaped housing 20 having a longitudinal portion and a traverse portion, a longitudinal cavity 22 within the longitudinal portion, a first cavity 24 and a second cavity 26 in a position within the traverse portion near distal ends, and a thermal switch 30 within the longitudinal cavity 22. The thermal switch 30 is for electrically coupling mesial a power source and an electric motor 14 connected to a water pump. The thermal switch 30 is normally closed and wherein the thermal switch 30 opens when an extremely hot temperature is conducted from a pump housing 12.

Figure 4:
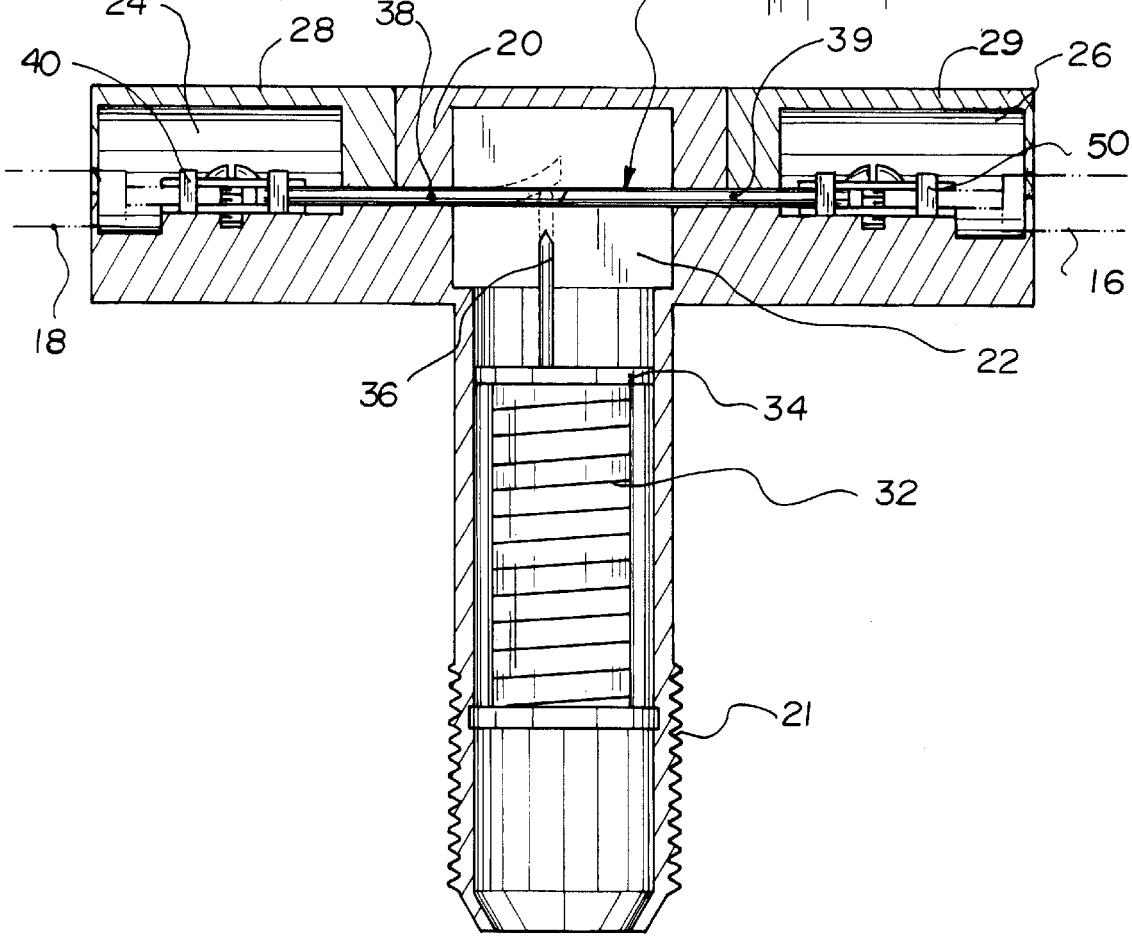
FIG. 4 is a cross sectional view taken along line 4—4 of FIG. 1.

As best shown in FIG. 4 of the drawings, the thermal switch 30 comprises a bimetallic compression spring 32 slidably positioned within a lower portion of the longitudinal cavity 22 for conducting heat from the pump housing 12 and expanding when the extremely hot temperature has been conducted. A first contact 38 projects from within the first cavity 24 into an upper portion of the longitudinal cavity 22. A second contact 39 projects from the second cavity 26 into the upper portion of the longitudinal cavity 22 to electrically couple to the first contact 38. A disc 34 is positioned on top of the bimetallic compression spring 32. A pin 36 is secured orthogonally to the disc 34 for engaging a bottom surface of the first contact 38 and separating the first contact 38 from the second contact 39 when the bimetallic compression spring 32 expands because of the extremely hot temperature.

As best shown in FIG. 1 through 5 of the drawings, the T-shaped housing 20 includes a first cover 28 pivotally secured to the traverse portion for removably enclosing the first cavity 24. A second cover 29 is pivotally secured to the traverse portion for removably enclosing the second cavity 26. A first wire clamp 40 is secured within the first cavity 24. The first wire clamp 40 is electrically coupled to the first contact 38 for electrically coupling to an outgoing wire 18 which is electrically coupled to the pump as best shown in FIG. 4 of the drawings. A second wire clamp 50 is secured within the second cavity 26. The second wire clamp 50 is electrically coupled to the second contact 39 for electrically coupling to an incoming wire 16 which is electrically coupled to the power source. The longitudinal portion preferably has a threaded end 21 opposite of the traverse portion for threadably engaging an unused port within the pump housing 12.

Figure 5:
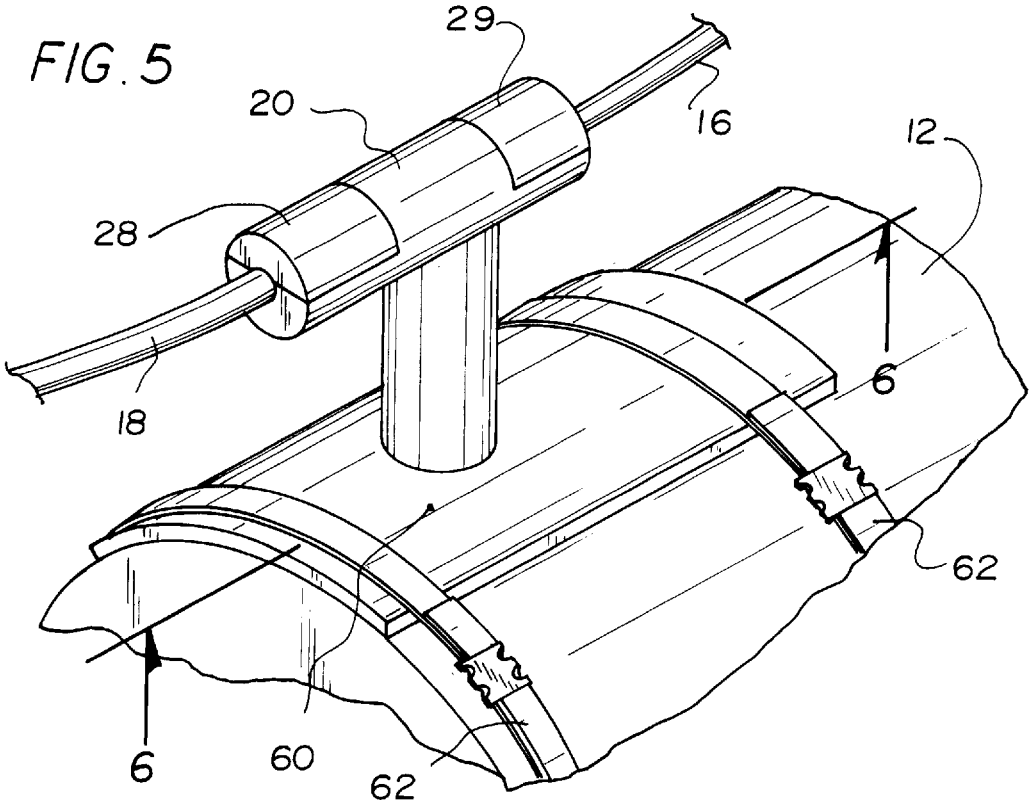
FIG. 5 is an upper side perspective view of an alternative embodiment of the present invention.
Figure 6:
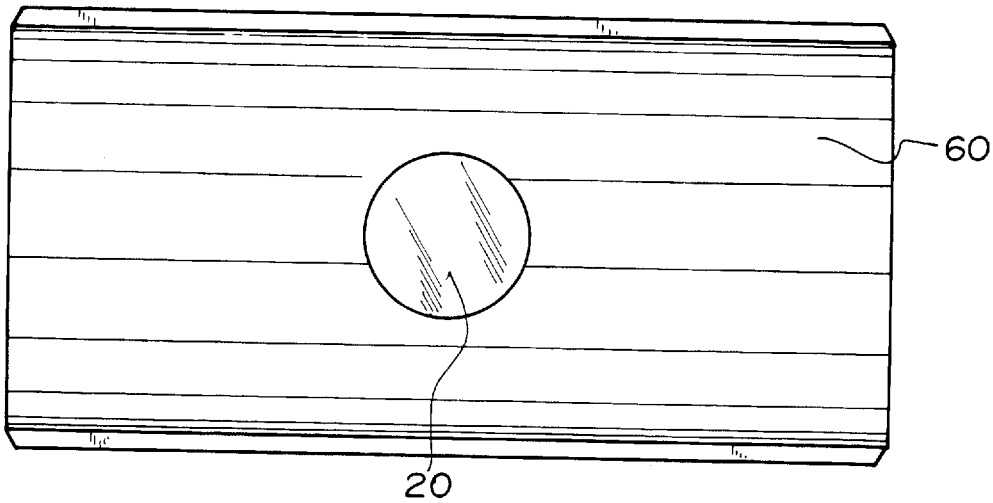
FIG. 6 is a cross sectional view taken along line 6—6 of FIG. 5.

In an alternative embodiment as shown in FIGS. 5 and 6 of the drawings, a plate 60 is formed to fit around a portion of the pump housing 12 for conducting heat from the pump. The longitudinal portion engages the plate 60 opposite of the traverse portion as shown in FIG. 6 of the drawings. At least one strap 62 secures the plate 60 juxtaposed to the pump housing 12.

In use, the threaded end 21 is threadably inserted into the unused port of tile pump housing 12. When the heat from the pump housing 12 reaches a certain temperature, the bimetallic compression spring 32 expands thereby forcing the pin 36 to engage the first contact 38 thereby separating the first contact 38 from the second contact 39. This opens the electrical connection between the first contact 38 and the second contact 39 thereby terminating electrical power to the electric motor 14 from the power source. When the temperatures drops to another level, the bimetallic compression spring 32 contracts thereby removing the pin 36 from being in contact with the first contact 38 thereby allowing the first contact 38 to electrically couple again to the second contact 39 thereby supplying electrical power again to the electric motor 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An automatic thermal shut-off switch comprising:

a T-shaped housing having a longitudinal portion and a traverse portion, said longitudinal portion extending substantially from a middle of said traverse portion;

a longitudinal cavity within said longitudinal portion;

a first cavity and a second cavity within said traverse portion, said first cavity being positioned opposite said second cavity, each of said first and said second cavities further being positioned near respective distal ends of said traverse portion;

a thermal switch within said longitudinal cavity for electrically coupling between a power source and an electric motor connected to a water pump, wherein said thermal switch is normally closed and wherein said thermal switch opens when an extremely hot temperature is conducted from a pump housing; and wherein said thermal switch includes a bimetallic compression spring slidably positioned within a lower portion of said longitudinal cavity for conducting heat from said pump housing and expanding when said extremely hot temperature has been conducted, a first contact projecting from said first cavity into an upper portion of said longitudinal cavity, a second contact projecting from said second cavity into said upper portion of said longitudinal cavity to electrically couple to said first contact, a disc positioned on top of said bimetallic compression spring, and a pin secured orthogonally to said disc for engaging a bottom surface of said first contact and separating said first contact from said second contact when said bimetallic compression spring expands because of said extremely hot temperature.

2. The automatic thermal shut-off switch of claim 1, wherein said T-shaped housing includes:

a first cover pivotally secured to said traverse portion for removably enclosing said first cavity; and a second cover pivotally secured to said traverse portion for removably enclosing said second cavity.

3. The automatic thermal shut-off switch of claim 2, including:

a first wire clamp secured within said first cavity and electrically coupled to said first contact for electrically coupling to an outgoing wire which is electrically coupled to said pump; and a second wire clamp secured within said second cavity and electrically coupled to said second contact for electrically coupling to an incoming wire which is electrically coupled to said power source.

4. The automatic thermal shut-off switch of claim 3, wherein said longitudinal portion includes a threaded end opposite of said traverse portion for threadably engaging an unused port within said pump housing.

5. The automatic thermal shut-off switch of claim 3, including:

a plate formed to fit around a portion of said pump housing for conducting heat from said pump;

said longitudinal portion engages said plate opposite of said traverse portion; and at least one strap securing said plate juxtaposed to said pump housing.

6. An automatic thermal shut-off switch system for a pump comprising:

a pump having a housing with an exterior surface;

a generally T-shaped housing having a longitudinal portion and a traverse portion, said longitudinal portion extending from a substantially medial location on said traverse portion;

a longitudinal cavity in said longitudinal portion;

a first cavity and a second cavity in said traverse portion, said first cavity being positioned opposite said second cavity, each of said first and said second cavities further being positioned near respective distal ends of said traverse portion;

a thermal switch located in said longitudinal cavity for electrically coupling between a power source and an electric motor connected to said pump, wherein said thermal switch is normally closed and wherein said thermal switch opens when the seitch detects that the temperature of the housing of said pump exceeds a pre-determined value; and wherein said thermal switch includes a bimetallic compression spring slidably positioned within a lower portion of said longitudinal cavity for conducting heat from said pump housing and expanding as heat is conducted from the housing of said pump, a first contact projecting from said first cavity into an upper portion of said longitudinal cavity, a second contact projecting from said second cavity into said upper portion of said longitudinal cavity to electrically couple to said first contact, a disc positioned on top of said bimetallic compression spring, and a pin secured orthogonally to said disc for engaging a bottom surface of said first contact and separating said first contact from said second contact when said bimetallic compression spring expands as a result of the housing of said pump reaching said pre-determined value.

* * * * *